US009269298B2

(12) United States Patent
Lin et al.

(10) Patent No.: US 9,269,298 B2
(45) Date of Patent: Feb. 23, 2016

(54) PIXEL DRIVING CIRCUITS, PIXEL DRIVING METHODS, DISPLAY PANELS AND ELECTRONIC DEVICES

(75) Inventors: Chih-Lung Lin, Chu-Nan (TW); Pin-Yen Kuo, Chu-Nan (TW); Chia-Che Hung, Chu-Nan (TW); Fu-Chieh Chang, Chu-Nan (TW)

(73) Assignees: INNOLUX CORPORATION, Chu-Nan (TW); INNOCOM TECHNOLOGY (SHENZHEN) CO., LTD., Shenzhen (CN)

( * ) Notice: Subject to any disclaimer, the term of this patent is extended or adjusted under 35 U.S.C. 154(b) by 494 days.

(21) Appl. No.: 13/615,208

(22) Filed: Sep. 13, 2012

(65) Prior Publication Data

US 2013/0207957 A1 Aug. 15, 2013

(30) Foreign Application Priority Data

Feb. 15, 2012 (TW) ..... 101104849 A

(51) Int. Cl.
*G09G 3/30* (2006.01)
*G09G 3/32* (2006.01)

(52) U.S. Cl.
CPC ..... *G09G 3/3241* (2013.01); *G09G 2310/0262* (2013.01); *G09G 2320/0219* (2013.01)

(58) Field of Classification Search
CPC ..... G09G 3/3241; G09G 2310/0262; G09F 2320/0219
USPC ..... 345/76, 212
See application file for complete search history.

(56) References Cited

U.S. PATENT DOCUMENTS

| | | | | |
|---|---|---|---|---|
| 8,077,126 | B2 * | 12/2011 | Lee et al. | 345/77 |
| 8,665,185 | B2 * | 3/2014 | Fan et al. | 345/76 |
| 2006/0244688 | A1 * | 11/2006 | Ahn et al. | 345/76 |
| 2007/0103419 | A1 | 5/2007 | Uchino et al. | |
| 2007/0164940 | A1 | 7/2007 | Guo et al. | |
| 2009/0002405 | A1 | 1/2009 | Ozaki | |
| 2009/0096721 | A1 * | 4/2009 | Chiou et al. | 345/76 |

FOREIGN PATENT DOCUMENTS

| | | |
|---|---|---|
| CN | 100524416 | 8/2009 |
| CN | 102254531 | 11/2011 |
| JP | 2006119180 | 5/2006 |
| TW | 201201178 | 1/2012 |

* cited by examiner

*Primary Examiner* — Kwang-Su Yang
(74) *Attorney, Agent, or Firm* — Liu & Liu

(57) ABSTRACT

A pixel driving circuit is provided, including first, second, third, fourth, and fifth switching devices and first and second capacitors. The first switching device has a first terminal coupled to a power source voltage, and a control terminal coupled to a first scan signal line. The second switching device has a first terminal coupled to a second terminal of the first switching device, a second terminal coupled between a first node and an emitting device, and a control terminal coupled to a second node. The third switching device has a first terminal coupled to the second node, a second terminal coupled between the first terminal of the second switching device and the second terminal of the first switching device, and a control terminal coupled to a second scan signal line.

16 Claims, 7 Drawing Sheets

PIXEL DRIVING CIRCUITS, PIXEL DRIVING METHODS, DISPLAY PANELS AND ELECTRONIC DEVICES

CROSS REFERENCE TO RELATED APPLICATIONS

This Application claims priority of Taiwan Patent Application No. 101104849, filed on Feb. 15, 2012, the entirety of which is incorporated by reference herein.

BACKGROUND OF THE INVENTION

1. Field of the Invention

The present invention relates to panel displays, and in particular to pixel driving circuits.

2. Description of the Related Art

In a pixel of an organic light-emitting diode (OLED) display, charges are stored in a storage capacitor for controlling the luminance of an OLED via a thin-film transistor (TFT). Referring to FIG. 1, a schematic diagram of a conventional pixel circuit is shown. The pixel circuit 100 includes an N-type TFT 102, a storage capacitor 104 and an OLED 106. The two ends of the storage capacitor 104 are respectively coupled to the gate G and the source S of the TFT 102. The voltage drop of the storage capacitor 104 is denoted by Vgs. The positive end of the OLED 106 is coupled to the source S of the TFT 102, whose voltage level is denoted by VOLED. The current flowing by the TFT 102 is controlled by the voltage drop Vgs, with the current IOLED of the OLED 106 being equal to K*(Vgs−VTH).sup.2. The voltage drop Vgs is the voltage difference between the pixel voltage Vdata and the voltage level VOLED at the positive end of the OLED 106. Therefore, the luminance of the OLED 106 can be controlled by adjusting the pixel voltage Vdata.

However, when the above-mentioned TFT 102 is operated, a shift of the threshold voltage occurs on the TFT 102. The amount of voltage shift is related to the manufacturing process, operation time, and the current of the TFT 102. Therefore, in terms of all pixels on the display panel, due to the difference of the pixels in the operation time, conductive current, and manufacturing process, the amount of shift of the threshold voltage of each pixel is different, which in turn causes the luminance and the received pixel voltage of each pixel to have a different corresponding relationship. Therefore, the issue of non-uniform frame luminance occurs.

In addition, the OLED 106 has an increasing voltage drop, which is an increasing VOLED, along with the usage time. Referring to FIG. 2, a characteristic diagram of the OLED 106 is shown. From FIG. 2, it can be seen that the OLED 106 has an increasing VOLED under a long usage time. Therefore, the conductive current IOLED is reduced under the long usage time according to the equation Vgs=Vdata−VOLED. The decreasing current IOLED causes the pixel voltage Vdata to be unable to drive the OLED 106 to reach the predetermined luminance. Thus the overall luminance of the display frame is reduced.

There is therefore a need for a pixel driving circuit and a pixel driving method thereof to solve the variation of the thin-film transistors (TFT) and the aging of the OLED 106.

BRIEF SUMMARY OF THE INVENTION

In light of the previously described problems, the invention provides an embodiment of a pixel driving circuit, including first, second, third, fourth, and fifth switching devices and first and second capacitors. The first switching device has a first terminal coupled to a power source voltage, and a control terminal coupled to a first scan signal line. The second switching device has a first terminal coupled to a second terminal of the first switching device, a second terminal coupled between a first node and an emitting device, and a control terminal coupled to a second node. The third switching device has a first terminal coupled to the second node, a second terminal coupled between the first terminal of the second switching device and the second terminal of the first switching device, and a control terminal coupled to a second scan signal line. The fourth switching device has a first terminal coupled to a data line, a second terminal coupled to the first node, and a control terminal coupled to a third scan signal line. The fifth switching unit has a first terminal coupled to the second node and a control terminal coupled to a fourth scan signal line. The first capacitor is coupled between a second terminal of the fifth switching unit and a ground terminal The second capacitor is coupled between the first and second nodes.

The disclosure also provides a pixel driving method applied to the pixel driving circuit. The pixel driving method includes the steps of: respectively discharging the first and second nodes to a first threshold voltage of the emitting device and a compensation voltage through the second and third switching units and the emitting device in a compensation stage, wherein the compensation voltage is the sum of the first threshold voltage and a second threshold voltage of the second switching unit; loading a data signal into the first node through the fourth switching unit according to a third scan signal output from the third scan signal line in a data input stage later than the compensation stage, wherein the data signal is a negative voltage; and delivering the data signal to the second node by the first and second capacitors in an emission stage later than the data input stage, such that the second switching unit generates a driving current to the emitting device according voltage level of the second node, wherein the driving current is dependent on the capacitances of the first and second capacitors.

The disclosure also provides a display panel including a pixel driving circuit. The pixel driving circuit includes first, second, third, fourth, and fifth switching devices and first and second capacitors as described above.

The disclosure also provides an electronic device having the display panel described above and a power supply. The power supply provides power to the display panel.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
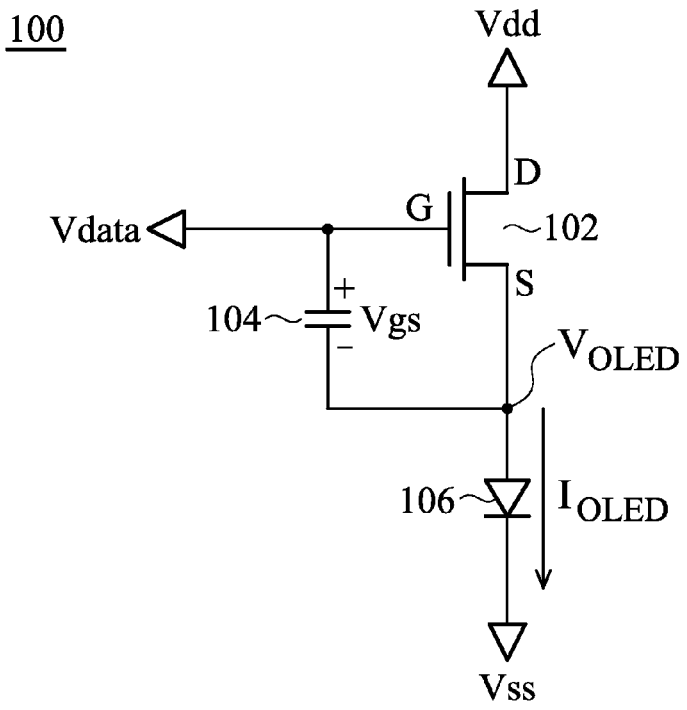
FIG. 1 ( PRIOR ART )
FIG. 1 is a schematic diagram of a conventional pixel circuit.
Figure 2:
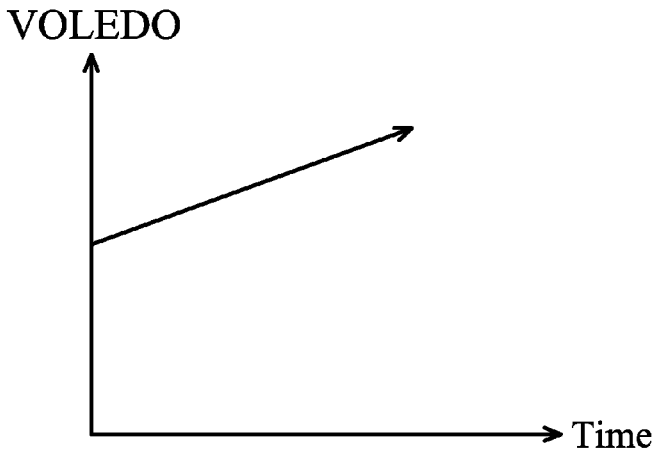
FIG. 2 ( PRIOR ART )
FIG. 2 is a characteristic diagram of the OLED.
Figure 3:
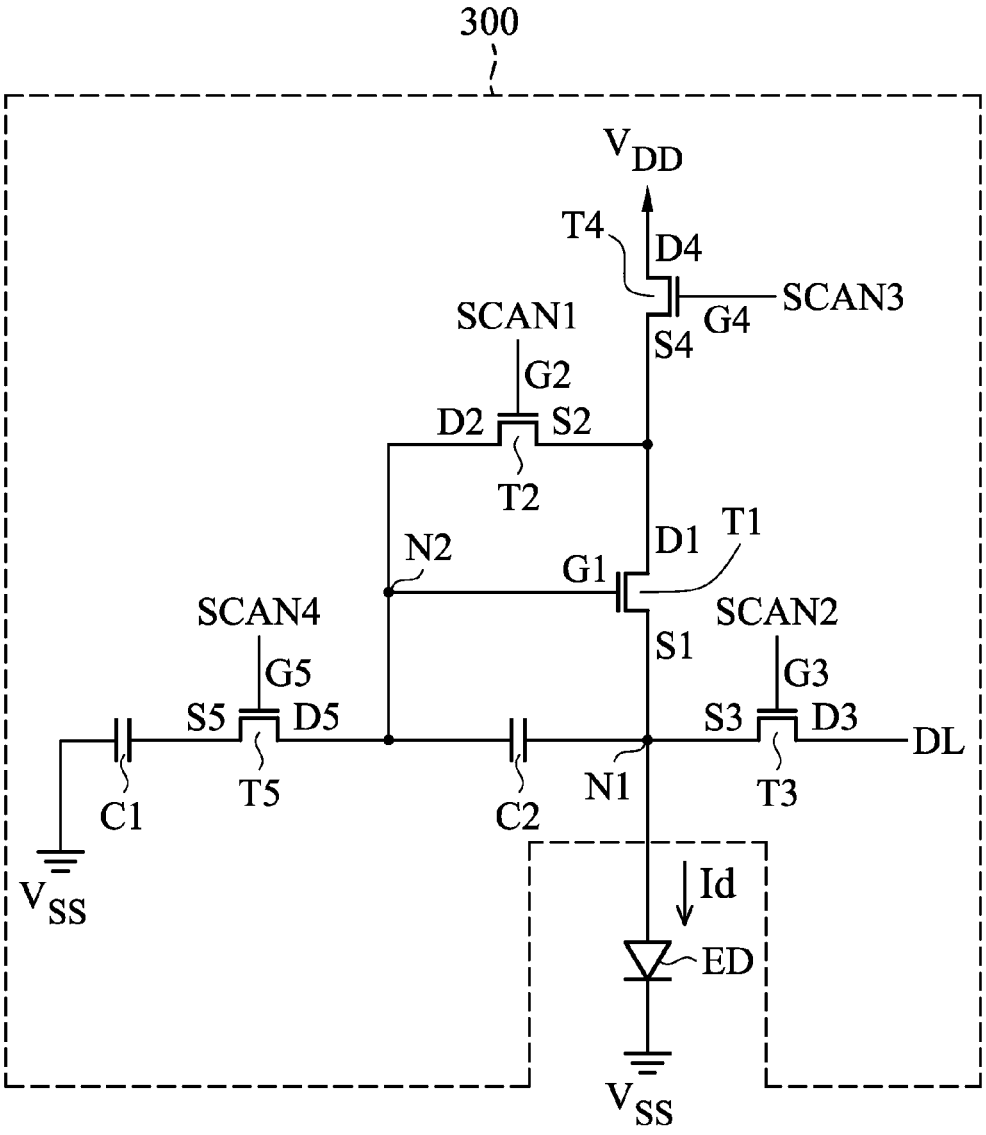
FIG. 3 illustrates an embodiment of the pixel driving circuit.

FIG. 3 illustrates an embodiment of the pixel driving circuit. As shown in FIG. 3, the pixel driving circuit 300 is configured to generate a driving current Id to an emitting device ED, such that the emitting device ED emits according to the driving current Id. In the embodiment, the emitting device ED is an organic light-emitting diode (OLED). The pixel driving circuit 300 includes switching units T1~T5 and capacitors C1~C2. In the embodiment, the switching units T1~T5 can be amorphous silicon thin-film transistors (a-Si TFT) or InGaZnO thin-film transistors (IGZO TFT), but are not limited thereto. Each of the switching units T1~T5 can be implemented by any of various kinds of N-type thin-film transistors.

In detail, the switching unit T4 has a first terminal D4 coupled to a power source voltage VDD, and a control terminal G4 coupled to a scan signal line SCAN3. The switching unit T1 has a first terminal D1 coupled to the second terminal S4 of the switching unit T4, a second terminal S1 coupled to a node N1 and the emitting device ED, and a control terminal G1 coupled to a node N2. The switching unit T2 has a first terminal D2 coupled to a node N2, a second terminal S2 coupled between the first terminal D1 of the switching unit T1 and the second terminal S4 of the switching unit T4, and the control terminal G2 coupled to a scan signal line SCAN1. The switching unit T3 has a first terminal D3 coupled to a data signal line DL, a second terminal S3 coupled to the node N1, and a control terminal G3 coupled to a scan signal line SCAN2. The switching unit T5 has a first terminal D5 coupled to the node N2 and a control terminal G5 coupled to a scan signal line SCAN4. The capacitor C1 is coupled between a second terminal S5 of the switching unit T5 and the ground terminal Vss. The capacitor C2 is coupled between the nodes N1 and N2.

Figure 4:
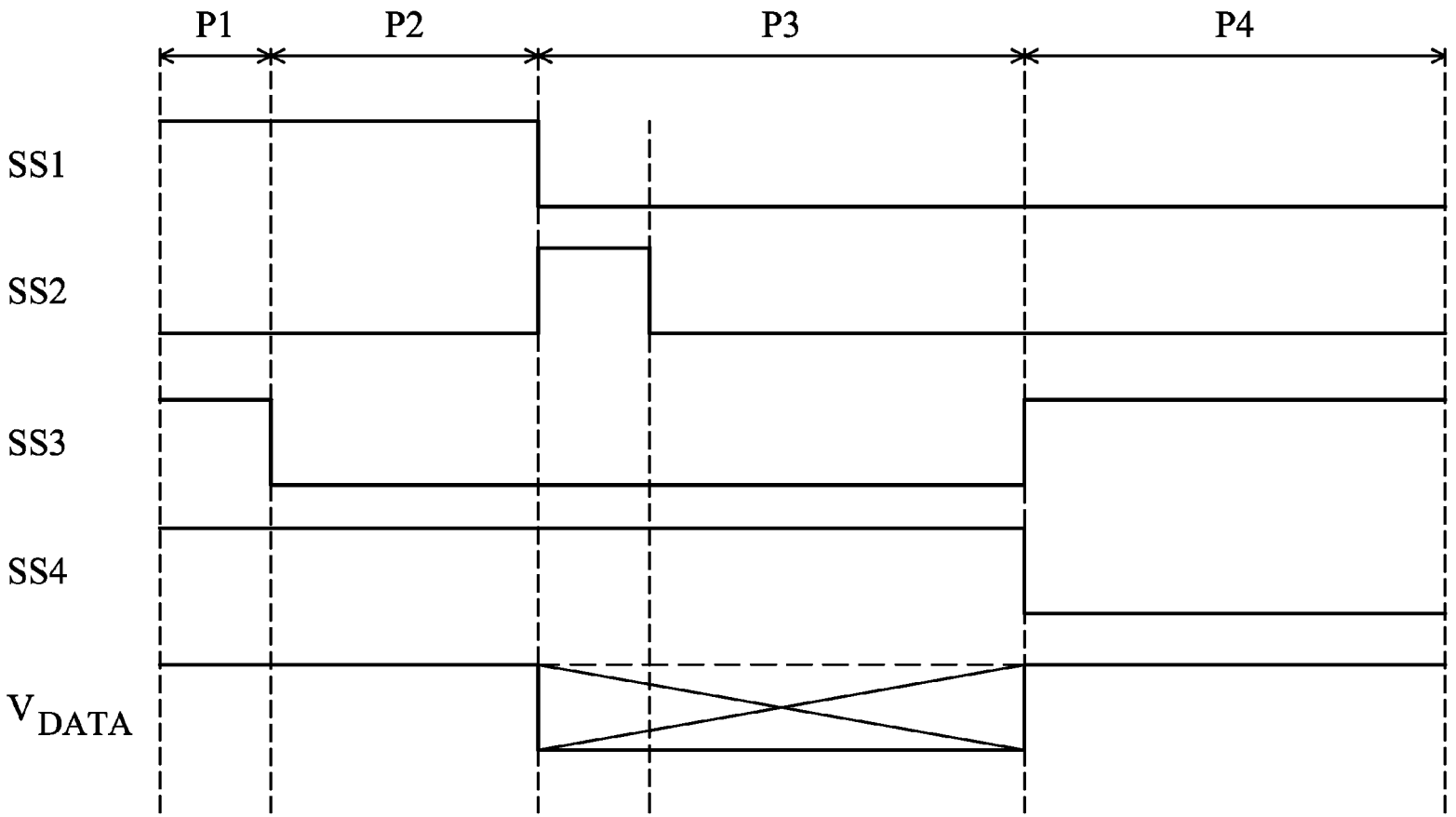
FIG. 4 illustrates the timing chart of the data signal Vdata and the scan signals SS1, SS2, SS3, and SS4 of the disclosure.

FIG. 4 illustrates a timing chart of the data signal Vdata and the scan signals SS1, SS2, SS3 and SS4 of the disclosure in order to illustrate the operation of the pixel driving circuit 300. As shown in FIGS. 3 and 4, a frame period sequentially includes a reset stage P1, a compensation stage P2, a data input stage P3 and an emission stage P4. In the reset stage P1, the switching units T4, T2 and T5 operate in an on-state according to the scan signals SS3, SS1, and SS4 respectively output from the scan signal lines SCAN3, SCAN1 and SCAN4. The switching unit T3 operates in an off-state according to the scan signal SS2 output from the scan signal line SCAN2, such that the switching units T4 and T2 charge the node N2 to a high voltage level according to the power source voltage VDD.

In the compensation stage P2 later than the reset stage P1, the switching unit T2 and T5 operate in the on-state according to the scan signals SS1 and SS4, and the switching unit T4 operates in the off-state according to the scan signal SS3, such that the switching unit T1 operates in a diode connection state and respectively discharges the nodes N1 and N2 to a threshold voltage VOLED0 of the emitting device ED and the compensation voltage Vcp, in which the compensation voltage Vcp is the sum of the threshold voltage VOLED0 and a threshold voltage Vth of the switching unit T1 (Vcp=VOLED0+Vth).

In the data input stage P3 later than the compensation stage P2, the switching units T3 and T5 operate in the on-state according to the scan signals SS2 and SS4, and the switching units T4, T1 and T2 operate in the off-state according to the scan signals SS3 and SS1, such that the switching unit T3 loads the data signal Vdata into the node N1. Therefore, the voltage level of the node N1 is changed from the threshold voltage VOLED0 to the data signal Vdata. Due to the voltage continuity of a capacitor at both ends, the capacitors C1 and C2 increase the voltage level of the node N2 from the compensation voltage Vcp to a first level V1, in which the first level V1 is $$VOLED0\times\left(\frac{C1}{C1+C2}\right)+Vth+Vdata\times\left(\frac{C2}{C1+C2}\right).$$

Note that the data signal Vdata is a negative voltage, such that the emitting device ED can not be turned on since the node N1 feeds a negative bias to the emitting device ED.

In the emitting stage P4 later than the data input stage P3, the switching units T2, T3, and T5 operate in the off-state according to the scan signals SS1, SS2 and SS4, and the switching unit T4 operates in the on-state according to the scan signal SS3, such that the switching unit T1 operates in a saturation state and generates the driving current Id to the emitting device ED according to the second level V2.

In detail, when the emitting device ED operates in the on-state, the voltage level of the node N1 is changed from the data signal Vdata to the threshold voltage VOLED1. Due to the voltage continuity of a capacitor at both ends, the voltage level of the node N2 is changed from the first level $$V1=VOLED0\times\left(\frac{C1}{C1+C2}\right)+Vth+Vdata\times\left(\frac{C2}{C1+C2}\right)$$

to the second level $$V2=VOLED0\times\left(\frac{C1}{C1+C2}\right)+Vth-Vdata\times\left(\frac{C1}{C1+C2}\right)+VOLED1.$$

Therefore, the gate-source voltage of the switching unit T1 can be described as follows:

$$\begin{aligned}Vgs&=V2-VOLED1\\&=VOLED0\times\left(\frac{C1}{C1+C2}\right)+Vth-Vdata\times\left(\frac{C1}{C1+C2}\right).\end{aligned}$$

Since Vgs (the gate-source voltage of the switching unit T1)>Vth and Vds (the drain-source voltage of the switching unit T1)>(Vgs−Vth), the switching unit T1 operates in the saturation state, and the driving current Id is only dependent on the gate voltage of the switching unit T1. The description of the driving current Id is shown as following:

$$\begin{aligned}Id&=K(Vgs-Vth)^2\\&=K\left[VOLED0\times\left(\frac{C1}{C1+C2}\right)+Vth-Vdata\times\left(\frac{C1}{C1+C2}\right)-Vth\right]^2\\&=K\left[VOLED0\times\left(\frac{C1}{C1+C2}\right)-Vdata\times\left(\frac{C1}{C1+C2}\right)\right]^2.\end{aligned}$$

K represents the gain coefficient of the transistors. Obviously, when the emitting device ED operates in the on-state, the driving current Id is independent of the threshold voltage Vth of the switching unit T1 and the open circuit threshold voltage VOLED1 of the emitting device ED. Therefore, the brightness uniformity of the pixel driving circuits 300 can not be generated by variations in the threshold voltage of the transistors and the emitting device. In addition, because the driving current Id has some factors associated with the threshold voltage VOLED0 and the capacitors C1 and C2, the variations in the driving current Id generated by variations in the emitting devices ED can be reduced by adjusting the capacitances of the capacitors C1 and C2 of the pixel driving circuit 300.

Figure 5:
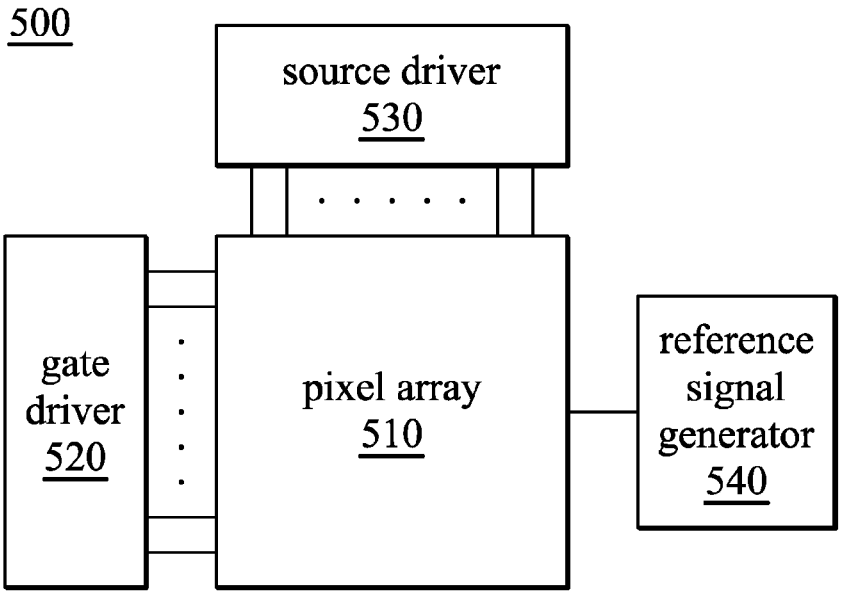
FIG. 5 illustrates an embodiment of the display panel.

FIG. 5 illustrates an embodiment of the display panel. As shown in FIG. 5, the display panel 500 comprises a pixel array 510, a gate driver 520, a source driver 530, and a reference signal generator 540. The pixel array 510 comprises pixel driving circuits, such as the embodiment of the pixel driving circuit 300 shown in FIG. 3.

The gate driver 520 provides scan signals (e.g. the scan signals SS1~SS4) to the pixel array 510 such that scan lines are asserted or de-asserted. The source driver 530 provides the data signals to the pixel driving circuits in the pixel array 510. The reference signal generator 540 provides the reference signals to the pixel driving circuits 300 in the pixel array 510, and can be integrated into the gate driver 520. Notably, the display panel 500 can be an organic light-emitting diode (OLED) display panel; however, various other technologies can be used in other embodiments.

Figure 6:
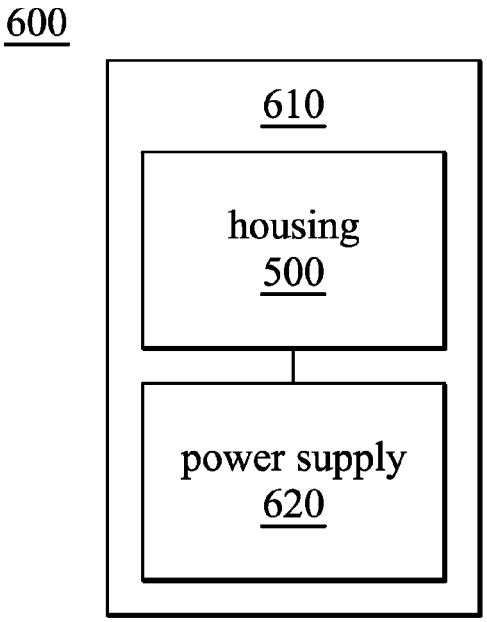
FIG. 6 illustrates an embodiment of the electronic device.

FIG. 6 illustrates an embodiment of the electronic device. In particular, the electronic device 600 employs the previously described display panel 500 of FIG. 5. The electronic device 600 may be a device such as a PDA, notebook computer, tablet computer, cellular phone, or a display monitor device, for example.

Generally, the electronic device 600 includes a housing 610, a display panel 500, and a power supply 620, although it is to be understood that various other components can be included; however, such other components are not shown or described here for ease of illustration and description. In operation, the power supply 620 powers the display panel 500 so that the display panel 500 can display images.

Figure 7:
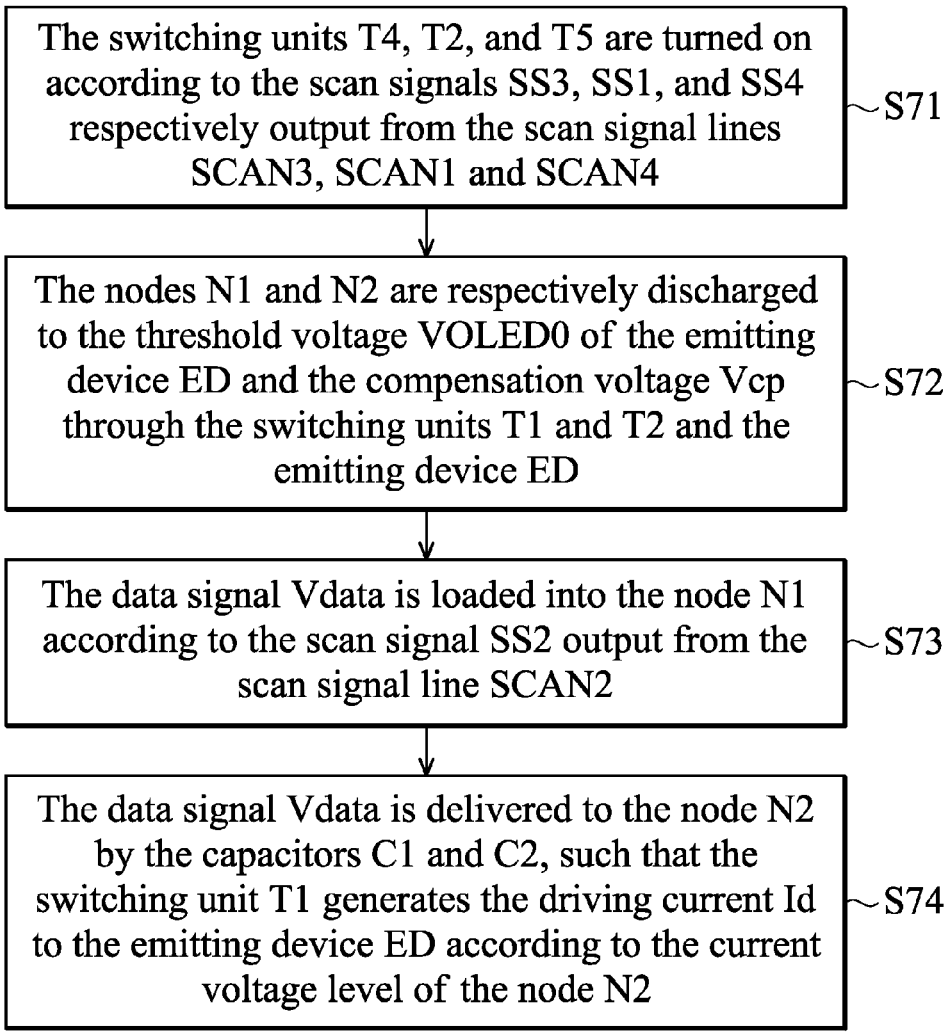
FIG. 7 illustrates the flowchart of the pixel driving method of the disclosure.

FIG. 7 illustrates a flowchart of the pixel driving method of the disclosure in which the pixel driving method is applied to the pixel array 510. Note that the whole pixels in the pixel array 510 operate together in the reset stage P1, the compensation stage P2, and the emission stage P4, but each row of the scan signal lines SCAN2 are sequentially enabled in the data input stage P3. As shown in FIG. 7, the procedure enters step S71 in the reset stage P1, and the switching units T4, T2, and T5 are turned on according to the scan signals SS3, SS1, and SS4 respectively output from the scan signal lines SCAN3, SCAN1 and SCAN4, such that the power source voltage VDD charges the node N2 to the high voltage level.

The procedure enters step S72 in the compensation stage P2 later than the reset stage P1, and the nodes N1 and N2 are respectively discharged to the threshold voltage VOLED0 of the emitting device ED and the compensation voltage Vcp through the switching units T1 and T2 and the emitting device ED, in which the compensation voltage Vcp is the sum of the threshold voltage VOLED0 and the threshold voltage Vth of the switching unit T1 (i.e., Vcp=VOLED0+Vth). Note that the whole pixels in the display panel 500 are reset and compensated for together by the pixel driving procedure of the disclosure. In other words, the pixel driving circuit 300 is a synchronous-compensation-type pixel driving circuit.

The procedure enters step S73 in the data input stage P3 later than the compensation stage P2, and the data signal Vdata is loaded into the node N1 according to the scan signal SS2 output from the scan signal line SCAN2, in which the data signal Vdata is a negative voltage to protect the emitting device ED from being turned on in the data input stage P3.

The procedure enters step S74 in the emission stage P4 later than the data input stage P3, and the data signal Vdata is delivered to the node N2 by the capacitors C1 and C2, such that the switching unit T1 generates the driving current Id to the emitting device ED according to the current voltage level of the node N2, in which the driving current Id is dependent on the threshold voltage VOLED0 and the capacitances of the capacitors C1 and C2.

Note that the driving current Id has some factors associated with the threshold voltage VOLED0 and the capacitors C1 and C2, so the variations in the driving current Id generated by variations in the emitting devices ED can be reduced by adjusting the capacitances of the capacitors C1 and C2 of the pixel driving circuit 300. For example, when the threshold voltage VOLED0 is increased, the driving current Id generated by the pixel driving circuit 300 is correspondingly increased. Furthermore, the slope of the driving current Id can be adjusted by amending the capacitances of the capacitors C1 and C2 to compensate for the decrease of the whole brightness caused by the material aging. In other words, the pixel driving circuit 300 can be adjusted by tuning the capacitances of the capacitors C1 and C2 to adjust the compensation of the threshold voltage VOLED0. In addition, the pixel driving circuit 300 synchronously drives and compensates for the whole emitting devices in the display panel 500, in other words, the pixel driving circuit 300 is a synchronous-emission-type and synchronous-compensation-type pixel driving circuit.

Figure 8:
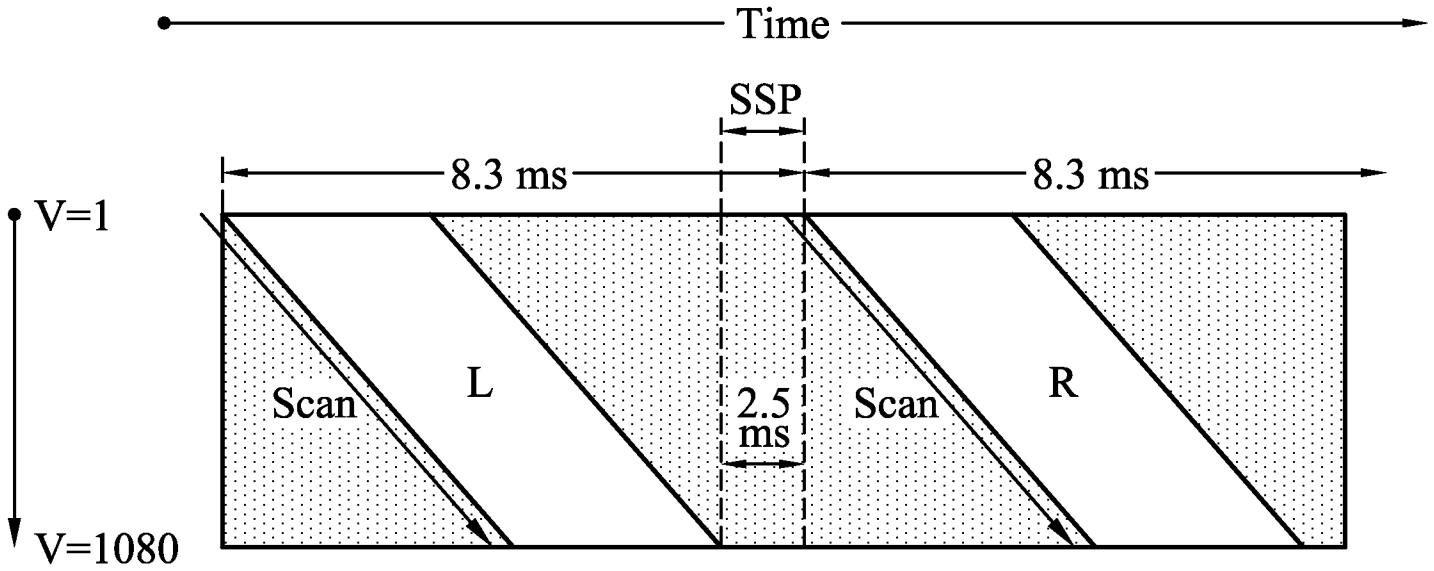
FIG. 8 is the timing chart of a progressive emission pixel driving circuit.
Figure 9:
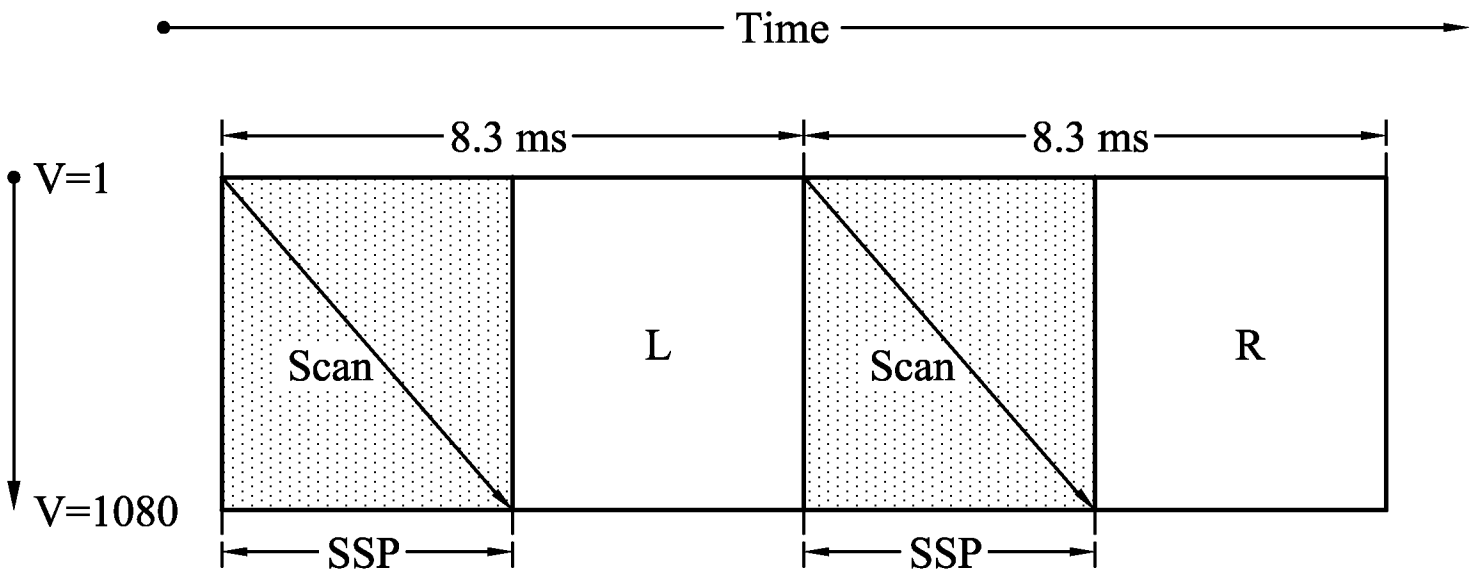
FIG. 9 is the timing chart of the embodiment of the pixel driving circuit.

FIG. 8 is the timing chart of a progressive-emission-type pixel driving circuit. FIG. 9 is the timing chart of the embodiment of the pixel driving circuit of the disclosure, in which R means the emission period of the right visual field, and L means the emission period of the left visual field. As shown in FIG. 8, each of the emission periods of the visual fields is about 4 ms, and the shutter switching period SSP (SSP means the time when the whole frames are in the blacking period) is about 2.5 ms. As shown in FIG. 9, since the pixel driving circuit of the disclosure is the synchronous-emission-type and synchronous-compensation-type pixel driving circuit, each of the emission periods of the visual fields is longer than 4 ms, and the shutter switching period SSP is about 4 ms. Compared with the progressive-emission-type pixel driving circuit, the blacking period of the pixel driving circuit of the disclosure is longer and is more helpful to switch the shutter in the shutter-glasses-type stereoscopic display device.

In conclusion, since the display panel 500 and the pixel driving circuit 300 are the synchronous-emission-type pixel driving circuits, the emission period of the display panel 500 or the pixel driving circuit 300 is longer than the emission period of the progressive-emission-type pixel driving circuit. In addition, since the display panel 500 synchronously compensates for the threshold voltage variations of the whole pixels, the full screen blacking period of the display panel 500 is longer than the full screen blacking period of the progressive-emission-type pixel driving circuit, such that the shutter-glasses-type stereoscopic display device has enough time to switch the shutters in the black frame periods. Since any kinds of the N-type thin-film transistors can be adapted in the disclosure, the switching units T1~T5 can be the InGaZnO thin-film transistors having high resolution, low power consumption, and high color saturation to drive the emission device ED. In addition, no matter how diverse the threshold voltage Vth shift of the switching unit T1 in each pixel is, and no matter what the decay extent of the emission device ED in each pixel is, the display can maintain the best image quality for a long usage time.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A pixel driving circuit, comprising a first switching device, having a first terminal coupled to a power source voltage, and a control terminal coupled to a first scan signal line;

a second switching device, having a first terminal coupled to a second terminal of the first switching device, a second terminal coupled between a first node and an emitting device, and a control terminal coupled to a second node;

a third switching device, having a first terminal coupled to the second node, a second terminal coupled between the first terminal of the second switching device and the second terminal of the first switching device, and a control terminal coupled to a second scan signal line;

a fourth switching device, having a first terminal coupled to a data line, a second terminal coupled to the first node, and a control terminal coupled to a third scan signal line;

a fifth switching unit, having a first terminal coupled to the second node and a control terminal coupled to a fourth scan signal line;

a first capacitor, coupled between a second terminal of the fifth switching unit and a ground terminal; and a second capacitor, coupled between the first and second nodes, wherein the second scan signal line, the third scan signal line and the fourth scan signal line separately controls the third switching device, the fourth switching device and the fifth switching device, respectively, and the second scan signal line, the third scan signal line and the fourth scan signal line are not electrically interconnected.

2. A pixel driving circuit, comprising a first switching device, having a first terminal coupled to a power source voltage, and a control terminal coupled to a first scan signal line;

a second switching device, having a first terminal coupled to a second terminal of the first switching device, a second terminal coupled between a first node and an emitting device, and a control terminal coupled to a second node;

a third switching device, having a first terminal coupled to the second node, a second terminal coupled between the first terminal of the second switching device and the second terminal of the first switching device, and a control terminal coupled to a second scan signal line;

a fourth switching device, having a first terminal coupled to a data line, a second terminal coupled to the first node, and a control terminal coupled to a third scan signal line;

a fifth switching unit, having a first terminal coupled to the second node and a control terminal coupled to a fourth scan signal line;

a first capacitor, coupled between a second terminal of the fifth switching unit and a ground terminal; and a second capacitor, coupled between the first and second nodes, wherein, in a reset stage, the first, third, and fifth switching units operate in an on-state according to the first, second, and fourth scan signals respectively output from the first, second, and fourth scan signal lines, such that the first and third switching units charge the second node to a high voltage level by the power source voltage, and wherein, in a compensation stage later than the reset stage, the third and fifth switching units operate in the on-state according to the second and fourth scan signals, and the first switching unit operates in an off-state according to the first scan signal, such that the second switching unit discharges the first node and second node to a first threshold voltage of the emitting device and a compensation voltage by the third switching unit and the emitting device, respectively, wherein the compensation voltage is the sum of the first threshold voltage and a second threshold voltage of the second switching unit.

3. The pixel driving circuit as claimed in claim 2, wherein, in a data input stage later than the compensation stage, the fourth and fifth switching units operate in the on-state according to the fourth scan signal and a third scan signal output from the third scan signal line, and the first, second and third switching units operate in the off-state according to the first and second scan signals, such that the fourth switching unit loads a data signal into the first node, wherein the data signal is a negative voltage.

4. The pixel driving circuit as claimed in claim 3, wherein, in an emission state later than the data input stage, the third, fourth, and fifth switching units operate in the off-state according to the second, third, and fourth scan signals, and the first switching unit operates in the on-state according to the first scan signal, such that the first and second capacitors deliver the data signal to the second node, and the second switching unit generates a driving current to the emitting device according to the voltage level of the second node.

5. The pixel driving circuit as claimed in claim 4, wherein the level of the driving current is dependent on the capacitances of the first and second capacitors, such that the variation of the first threshold voltage is compensated for by adjustment of the capacitances of the first and second capacitors.

6. The pixel driving circuit as claimed in claim 2, wherein the first, second, third, fourth, and fifth switching units are N-type transistors.

7. A display panel, comprising a pixel driving circuit, comprising:

a first switching device, having a first terminal coupled to a power source voltage, and a control terminal coupled to a first scan signal line;

a second switching device, having a first terminal coupled to a second terminal of the first switching device, a second terminal coupled between a first node and an emitting device, and a control terminal coupled to a second node;

a third switching device, having a first terminal coupled to the second node, a second terminal coupled between the first terminal of the second switching device and the second terminal of the first switching device, and a control terminal coupled to a second scan signal line;

a fourth switching device, having a first terminal coupled to a data line, a second terminal coupled to the first node, and a control terminal coupled to a third scan signal line;

a fifth switching unit, having a first terminal coupled to the second node and a control terminal coupled to a fourth scan signal line;

a first capacitor, coupled between a second terminal of the fifth switching unit and a ground terminal; and a second capacitor, coupled between the first and second nodes, wherein, in a reset stage, the first, third, and fifth switching units respectively operate in an on-state according to the first, second, and fourth scan signals respectively output from the first, second, and fourth scan signal lines, such that the first and third switching unit charge the second node to a high voltage level by the power source voltage, and wherein, in a compensation stage later than the reset stage, the third and fifth switching units operate in the on-state according to the second and fourth scan signals, and the first switching unit operates in an off-state according to the first scan signal, such that the second switching unit respectively discharges the first node and second node to a first threshold voltage of the emitting device and a compensation voltage by the third switching unit and the emitting device, wherein the compensation voltage is the sum of the first threshold voltage and a second threshold voltage of the second switching unit.

8. The display panel as claimed in claim 7, wherein, in a data input stage later than the compensation stage, the fourth and fifth switching units operate in the on-state according to the fourth scan signal and a third scan signal output from the third scan signal line, and the first, second, and third switching units operate in the off-state according to the first and second scan signals, such that the fourth switching unit loads a data signal into the first node, wherein the data signal is a negative voltage.

9. The display panel as claimed in claim 8, wherein, in an emission state later than the data input stage, the third, fourth, and fifth switching units operate in the off-state according to the second, third and fourth scan signals, and the first switching unit operates in the on-state according to the first scan signal, such that the first and second capacitors deliver the data signal to the second node, and the second switching unit generates a driving current to the emitting device according to the voltage level of the second node.

10. A pixel driving method applied to a pixel driving circuit that comprises:

a first switching device, having a first terminal coupled to a power source voltage, and a control terminal coupled to a first scan signal line;

a second switching device, having a first terminal coupled to a second terminal of the first switching device, a second terminal coupled between a first node and an emitting device, and a control terminal coupled to a second node;

a third switching device, having a first terminal coupled to the second node, a second terminal coupled between the first terminal of the second switching device and the second terminal of the first switching device, and a control terminal coupled to a second scan signal line;

a fourth switching device, having a first terminal coupled to a data line, a second terminal coupled to the first node, and a control terminal coupled to a third scan signal line;

a fifth switching unit, having a first terminal coupled to the second node and a control terminal coupled to a fourth scan signal line;

a first capacitor, coupled between a second terminal of the fifth switching unit and a ground terminal; and a second capacitor, coupled between the first and second nodes, wherein the pixel driving method comprises:

respectively discharging the first and second nodes to a first threshold voltage of the emitting device and a compensation voltage through the second and third switching units and the emitting device in a compensation stage, wherein the compensation voltage is the sum of the first threshold voltage and a second threshold voltage of the second switching unit;

loading a data signal into the first node through the fourth switching unit according to a third scan signal output from the third scan signal line in a data input stage later than the compensation stage, wherein the data signal is a negative voltage; and delivering the data signal to the second node by the first and second capacitors in an emission stage later than the data input stage, such that the second switching unit generates a driving current to the emitting device according to the voltage level of the second node, wherein the driving current is dependent on the capacitances of the first and second capacitors.

11. The pixel driving method as claimed in claim 10, further comprising:

turning on the first, third and fifth switching units according to first, second, and fourth scan signals respectively output from the first, second, and fourth scan signal lines in a reset stage earlier than the compensation stage, such that the power source voltage charges the second node to a high voltage level.

12. The pixel driving method as claimed in claim 11, wherein the third and fifth switching units are turned on according to the second and fourth scan signals in the compensation stage, and the first switching unit is turned off according to the first scan signal.

13. The pixel driving method as claimed in claim 12, wherein, in the data input stage, the fifth switching unit is turned on according to the fourth scan signal, and the first, second, and third switching units are turned off according to the first and second scan signals.

14. The pixel driving method as claimed in claim 13, wherein, in the emission stage, the third, fourth and fifth switching units are turned off according to the second, third and fourth scan signals, and the first switching unit is turned on according to the first scan signal.

15. The pixel driving method as claimed in claim 14, wherein the variation of the first threshold voltage is compensated for by adjustment of the capacitances of the first and second capacitors.

16. The pixel driving method as claimed in claim 10, wherein the first, second, third, fourth, and fifth switching units are N-type transistors.

* * * * *